US010223904B2

(12) United States Patent
Malhotra et al.

(10) Patent No.: US 10,223,904 B2
(45) **Date of Patent: *Mar. 5, 2019**

(54) AUTOMATIC SECURITY SYSTEM MODE SELECTION

(71) Applicant: Google LLC, Mountain View, CA (US)

(72) Inventors: Mark Rajan Malhotra, San Mateo, CA (US); Jeffrey Alan Boyd, Novato, CA (US); Sophie Le Guen, Burlingame, CA (US); Jeffery Theodore Lee, Los Gatos, CA (US); Prashant Reddy, Pittsburgh, PA (US); Patrick Lister, Cupertino, CA (US); Jesse Boettcher, San Jose, CA (US); Josh Buffum, Rocklin, CA (US)

(73) Assignee: Google LLC, Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/911,852

(22) Filed: Mar. 5, 2018

(65) Prior Publication Data

US 2018/0197406 A1 Jul. 12, 2018

Related U.S. Application Data

(63) Continuation of application No. 15/331,475, filed on Oct. 21, 2016, now Pat. No. 9,911,319, which is a (Continued)

(51) Int. Cl.
*G08B 29/18* (2006.01)
*G08B 25/00* (2006.01)
(Continued)

(52) U.S. Cl.
CPC ..... *G08B 29/185* (2013.01); *G08B 25/008* (2013.01); *G08B 19/00* (2013.01); *G08B 21/0423* (2013.01)

(58) Field of Classification Search
CPC ..... G08B 13/00; G08B 13/22; G08B 13/24; G08B 13/26; G08B 25/009; G08B 25/12; (Continued)

(56) References Cited

U.S. PATENT DOCUMENTS 4,461,221 A 7/1984 Schandle et al.
5,319,362 A 6/1994 Hyatt, Jr.
(Continued)

OTHER PUBLICATIONS

International Search Report and Written Opinion dated Oct. 25, 2016 as received in Application No. PCT/US2015/065745.
(Continued)

*Primary Examiner* — Van T Trieu
(74) *Attorney, Agent, or Firm* — Morris & Kamlay LLP

(57) ABSTRACT

Systems and techniques are provided for automatic security system mode selection. A set of signals may be received from sensors distributed in an environment with a security system. The security system may be in a first mode. An occupancy model may be received. An occupancy estimate may be generated for the environment based on the set of signals from the sensors and the occupancy model. Mode rules may be received. The mode rules associate occupancy estimates with modes of the security system. A second mode for the security system may be determined based on the occupancy estimate and mode rules. The second mode may be different from the first mode. The mode of the security system may be automatically changed from the first mode to the second mode.

20 Claims, 6 Drawing Sheets

Related U.S. Application Data continuation of application No. 14/585,491, filed on Dec. 30, 2014, now Pat. No. 9,508,250.

(51) Int. Cl.
*G08B 21/04* (2006.01)
*G08B 19/00* (2006.01)

(58) Field of Classification Search
CPC .... G08B 29/185; G08B 31/00; G08B 21/182; G08B 21/22; G08B 21/24; G98B 25/00
See application file for complete search history.

(56) References Cited

U.S. PATENT DOCUMENTS

| | | | | |
|---|---|---|---|---|
| 7,973,659 | B2 | 7/2011 | Sharma et al. | |
| 8,090,364 | B2 | 1/2012 | Delalat | |
| 9,064,394 | B1 | 6/2015 | Trundle | |
| 9,640,055 | B2 * | 5/2017 | Fadell | G08B 19/005 |
| 9,959,727 | B2 * | 5/2018 | Fadell | G08B 19/005 |
| 2005/0270151 | A1 | 12/2005 | Winick | |
| 2011/0032423 | A1 | 2/2011 | Jing et al. | |
| 2012/0019353 | A1 | 1/2012 | Knasel | |
| 2012/0066168 | A1 | 3/2012 | Fadell et al. | |
| 2012/0084857 | A1 | 4/2012 | Hubner et al. | |
| 2014/0263678 | A1 | 9/2014 | Schnell et al. | |

OTHER PUBLICATIONS

Partial International Search Report dated Sep. 2, 2016 as received in Application No. PCT/US2015/065745.

* cited by examiner

AUTOMATIC SECURITY SYSTEM MODE SELECTION

CROSS-REFERENCE TO RELATED APPLICATIONS

This application is a continuation of U.S. application Ser. No. 15/331,475, filed Oct. 21, 2016, now U.S. Pat. No. 9,911,319, which is a continuation of U.S. application Ser. No. 14/585,491, filed Dec. 30, 2014, now U.S. Pat. No. 9,508,250, and expressly incorporated herein by reference in its entirety.

BACKGROUND

Current security systems rely on various modes to determine how the security system reacts to signals from sensors monitoring the environment secured by the system. For example, when a security system is in an armed mode, the system may generate alerts when certain sensors generate signals indicating a possible security breach, whereas the security system may take no action after receiving the same signals if the security system is not in an armed mode.

For example, a motion sensor may detect motion in the living room of a home. If the security system is in an armed mode, the signal from the motion sensor indicating the detection of motion may cause the security system to generate an alert, alarm, or other such notification to a resident of the home or security company that there may be an intruder in the home. If the security system is not in an armed mode, no such alert, alarm, or notification may be generated.

The mode of the security system may need to be set manually by a user of the system. For example, the last occupant to leave a home in the morning may need to set the security system to an armed mode, and the first occupant to arrive in the evening may need to set the security system back to a disarmed mode. Failure to set the security system to the proper mode may result in unnecessary alerts, or the failure of the security system to detect intruders or other security breaches in the home.

BRIEF SUMMARY

According to an embodiment of the disclosed subject matter, a set of signals may be received from sensors distributed in an environment with a security system. The security system may be in a first mode. An occupancy model may be received. An occupancy estimate may be generated for the environment based on the set of signals from the sensors and the occupancy model. Mode rules may be received. The mode rules associate occupancy estimates with modes of the security system. A second mode for the security system may be determined based on the occupancy estimate and mode rules. The second mode may be different from the first mode. The mode of the security system may be automatically changed from the first mode to the second mode.

The mode rules may be determined to permit an automatic mode change of the security system without input from a user. The mode of the security system may be automatically changed from the first mode to the second mode without input from the user. The mode rules may be determined to not permit an automatic mode change of the security system. A mode change request may be sent to a computing device associated with a user. A response may be received to the mode change request authorizing the mode change. The mode of the security system may be changed from the first mode to the second mode.

The computing device associated with the user may be a hub computing device of the security system, a personal computing device of the user, or a speaker system. The occupancy model may include a set of machine learning weights for use with a machine learning system. The machine learning system may be trained to estimate the occupancy of the environment using supervised training, unsupervised training, online training, and offline training. The occupancy model may encode a model of the occupancy of the environment based on the set of signals from the sensors. The mode rules may be either parameter-based rules or conditional-clause based rules.

The occupancy estimate may include an indication of the number and identity of occupants in the environment; whether the occupants are residents, known guests, or unknown, a number of pets in the environment, locations of occupants and pets within the environment, whether any occupants have recently entered or exited the environment, whether any occupants are expected to enter or exit the environment in the near future, and a length of time an occupant who is a resident has been present in or absent from the environment.

To determine a new mode for the security system based on the occupancy estimate and mode rules, the occupancy estimate may be matched to one of the mode rules. Matching may use one of a best match and an exact match.

The user may be a resident of the environment. The user may be the resident of the environment who has most recently left or is expected to arrive at the environment when the environment is unoccupied.

To change the mode of the security system from the first mode to the second mode, the state of one of the sensors, a control, or a hub computing device for the security system may be changed. To change the state of one of the sensors, the sensor may be placed in an armed state from a disarmed state, or the sensor may be placed in a disarmed state from an armed state.

The control may be a lock. To change the state of the control, the lock may be placed in a locked state from an unlocked state, or the locked may be placed in an unlocked state from a locked state.

When the mode rules do not permit an automatic mode change for the security system, a delay period may be received from the computing device associated with the user. The length of the delay period may be waited before the mode of the security system may be changed from the first mode to the second mode when the response authorizes a mode change.

After automatically changing the mode of the security system from the first mode to the second mode without input from a user, a notification of the mode change from the first mode to the second mode may be sent to the computing device associated with the user.

An override indication may be received from the computing device associated with the user. The mode of the security system may be changed from the second mode to the first mode. The modes of the security system may include stay mode, home mode, night mode, vacation mode, and away mode. The modes of the security system may include armed modes, disarmed modes, and combination modes. When the security system is in a combination mode, one of the sensors may be in an armed state, and one of the sensors may be in a disarmed state.

Before an occupancy estimate for the environment is generated based on the set of signals from the sensors and the occupancy model, the set of signals may be filtered to remove signals that are not related to determining the occupancy of the environment.

According to an embodiment of the disclosed subject matter, a means for receiving a set of signals from sensors distributed in an environment with a security system, where the security system is in a first mode, a means for receiving an occupancy model, a means for generating an occupancy estimate for the environment based on the set of signals from the sensors and the occupancy model, a means for receiving mode rules, where the mode rules associate occupancy estimates with modes of the security system, a means for determining a second mode for the security system based on the occupancy estimate and mode rules, where the second mode is different from the first mode, a means for automatically changing the mode of the security system from the first mode to the second mode, a means for determining that the mode rules permit an automatic mode change of the security system without input from a user, a means for automatically changing the mode of the security system from the first mode to the second mode without input from the user, a means for determining that that the mode rules do not permit an automatic mode change of the security system, a means for sending a mode change request to one computing device associated with a user, a means for receiving a response to the mode change request authorizing the mode change, a means for changing the mode of the security system from the first mode to the second mode, a means for changing the state of one of the sensors, a control, or a hub computing device for the security system, a means for placing the sensor in an armed state from a disarmed state, a means for placing the sensor in a disarmed state from an armed state, a means for placing the lock in a locked state from an unlocked state, a means for and placing the lock in an unlocked state from a locked state, a means for receiving a delay period from the computing device associated with the user, a means for waiting the length of the delay period before changing the mode of the security system from the first mode to the second mode when the response authorizes a mode change, a means for sending a notification of the mode change from the first mode to the second mode to the computing device associated with the user after automatically changing the mode of the security system from the first mode to the second mode without input from a user, a means for receiving an override indication from the computing device associated with the user, a means for changing the mode of the security system from the second mode to the first mode, and a means for filtering the set of signals to remove signals that are not related to determining the occupancy of the environment before generating an occupancy estimate for the environment based on the set of signals from the one or more sensors and the occupancy model, are included.

Additional features, advantages, and embodiments of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

DETAILED DESCRIPTION

Figure 1:
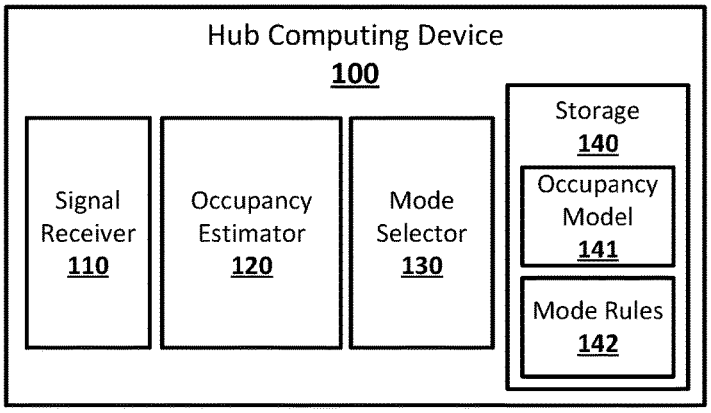
FIG. 1 shows an example system suitable for automatic security system mode selection according to an implementation of the disclosed subject matter.

According to embodiments disclosed herein, automatic security system mode selection may allow a smart home environment to determine the current and expected occupancy of an environment and which mode a security system should be in based on the occupancy of the environment, and to automatically change the security system to that mode. This may allow for the security system of a smart home environment to be set to an appropriate mode without requiring the occupants to determine which mode to set the security system to and manually change the mode themselves. The environment may be, for example, a home, office, apartment, condo, or other structure, and may include a combination of enclosed and open spaces. Signals may be received from sensors in the smart home environment. The sensors may monitor the environment for indications that persons and animals are present or absent from the environment. The sensors may be, for example, low power motion sensors, such as a passive infrared sensor used for motion detection, light sensors, cameras, microphones, entryway sensors, smart light switches, mobile device scanners for detecting the presence of mobile computing devices or fobs via WiFi, Bluetooth, and RFID, and the like. The signals from the sensor may be used by a machine learning system with an occupancy model of the environment to generate an occupancy estimate for the environment for the environment, which may include which people and animals are present or absent from the environment, and whether they are currently entering or leaving the environment. The occupancy estimate may be used by a mode selector to select an appropriate mode for the security system of the smart home environment based on any number of rules governing when different modes are appropriate. For example, a mode rule may state that an environment that has no human occupants, but does have recognized animal occupants, should be set to an "away" mode, in which the security system is armed. The applicable mode rules may permit the smart home environment to automatically change the mode of the security system, or may require that a user of the security system be sent a request to authorize the change of mode.

The smart home environment may include a hub computing device, which may be any suitable computing device for managing the smart home environment, including a security system of the smart home environment and automation system including other functions beyond security. The hub computing device may be a controller for a smart home environment. For example, the hub computing device may be or include a smart thermostat. The hub computing device also may be another device within the smart home environment, or may be a separate computing device dedicated to managing the smart home environment. The hub computing device may be connected, through any suitable wired and wireless connections, to a number of sensors distributed throughout an environment. For example, the hub computing device, sensors, and other components of the smart home environment may be connected in a mesh network. Some of the sensors may, for example, be motions sensors, including passive infrared sensors used for motion detection, light sensors, cameras, microphones, entryway sensors, smart light switches, as well as mobile device scanners that may use Bluetooth, WiFi, RFID, or other wireless devices as sensors to detect the presence of devices such as smartphones, tablets, laptops, or fobs. Sensors may be distributed individually, or may be combined with other sensors in sensor devices. For example, a sensor device may include a low power motion sensor and a light sensor, or a microphone and a camera, or any other combination of available sensors.

The smart home environment may include a security system, which may include any number of modes. For example, the security system may include a stay mode and a vacation mode. The stay mode may include a home mode, an away mode, and a night mode. Setting the security system to a stay mode may indicate that the occupants of the environment are expected to be in and out over the course of the day. The home mode may indicate that there is at least one human occupant in the environment, while the away mode may indicate no human occupants. The night mode may indicate that the occupants are going to be in the house for the night, for example, sleeping. The vacation mode may indicate that the occupants of the environment expect to be away from the environment for some period of time longer than a day.

The modes of the security system may be armed modes or disarmed modes, or combination modes. For example, the vacation mode may be an armed mode, while the home mode may be a disarmed mode, or a combination mode. When the security system is in an armed mode, the sensors in the environment may be considered armed. Signals from an armed sensor may be checked to determine if the sensor has been tripped. For example, an armed motion sensor may be tripped when it detects motion, and an armed entryway sensor may be tripped when the monitored entryway is opened or otherwise disturbed. The tripping of an armed sensor may result in the generation of an alarm, alert, or other such notification, as the tripping may indicate the presence of an unauthorized person or other intruder in the environment. Sensors that are disarmed may not be tripped. In a combination mode, certain sensors in the environment may be armed, while other sensors may be disarmed. For example, in a home mode, sensors monitoring external entryways may be armed, while sensors monitoring internal entryways and motion may be disarmed. This may allow, for example, alarms to be generated when someone tries to enter a home, while not having alarms set off by motion within the home. The modes of the security system may also manage other controls throughout the smart home environment. For example, when the security system is set to the vacation mode, a smart thermostat may be set to a low energy mode, and smart light switches may be switched on an off to simulate the presence of occupants in the home to discourage potential intruders.

Modes of the security system, and which sensors are armed and disarmed in those modes, may be specific to the environment in which the smart home environment is installed. For example, the night mode for a home may arm different sensors than the night mode for an office, as movement may be expected within a home at night, but not within an office.

Signals from the sensors distributed throughout the environment may be sent to the hub computing device. The hub computing device may use the signals received from the sensors to make determinations about the environment, including managing the security system and automation functions of the smart home environment. For example, the hub computing device may use signals received from the sensors to determine how many occupants, including people and pets, are in a home, based on motion sensing, voice, face, and motion recognition through cameras, changing light levels reported by light sensors, turning on and off of smart light switches, and detection of computing devices, such as smartphone or tablets, or fobs associated with residents of the home or guests in the home, or pets.

The hub computing device may use a machine learning system to generate an occupancy estimate of the environment based on the signals received from the sensors and an occupancy model of the environment. The signals used by the machine learning system may be occupancy signals, which may be any signal that may provide indications of whether or not persons or pets are in the environment. For example, signals from a motion detector may be occupancy signals, while signals from a carbon monoxide detector may not be occupancy signals, as they may not be useful in determining the presence or absence of any occupant from the environment. The hub computing device may also factor in time of day, day of week, day of month, and month of year when generating the occupancy estimate.

The machine learning system may be any suitable machine learning system for using the occupancy signals to generate an occupancy estimate. The machine learning system may be, for example, a Bayesian network, artificial neural network, support vector machine, or any other suitable statistical or heuristic machine learning system type. The occupancy model may be, for example, a set of weights or vectors suitable for use with the machine learning system. The machine learning system may be supervised or unsupervised, and may implement any suitable combination of online and offline learning.

For example, the machine learning system may be trained through feedback from a user of the smart home environment, as the machine learning system may produce occupancy estimates which may be corrected by the user until the occupancy model of the machine learning system is accurate enough to no longer require feedback. Supervised learning of the machine learning system may also be governed by a set of rules for sensor input, which may be used to correct occupancy estimates of the machine learning system and adjust the occupancy model. For example, the machine learning system may generate an occupancy estimate based on signals from the various sensors in the smart home environment which includes an estimation of a person in a basement. A rules-based interpretation of signals from the basement may contradict this estimate. For example, signals from an entryway sensor may indicate that the basement door is closed and has not been opened recently, and no motion may have been detected in the basement. The occupancy estimate from the machine learning system may be corrected, and the occupancy model may be updated based on the correction, further training the machine learning system.

The machine learning system may also be pre-trained. For example, the hub computing device may come installed with a pre-trained occupancy model, which may have been trained in a general environment similar to the environment in which it is installed. For example, a hub computing device installed in a free-standing house may have an occupancy model based on a generic free-standing house, which may differ from an occupancy model for a generic apartment or office. The generic occupancy model may then be further trained, either through supervised or unsupervised learning, in the environment in which it is installed.

The occupancy estimate generated by the machine learning system of the hub computing device may include estimates for how many people are in the environment, whether they are residents or guests, where they are in the environment, whether they have recently entered or exited the environment, and an estimate of when they may be entering or exiting the environment. The occupancy estimate may also include an estimate of the number and location of pets within the environment. For example, in a house owned by a family with two adults, two children, and one dog, the occupancy estimate may include estimates of the locations of each of the adults and children and the dog. For example, during the early afternoon on a weekday, the occupancy estimate may indicate that the two adults who are residents of the house are not present, the two children are present, a person who is a guest is present, and the dog is present. The guest may be, for example, a babysitter, who may be identified though a fob, wired or wireless connections of a personal computing device, face or voice recognition, entry of a PIN or other password into the hub computing device either directly or through an interface of a personal computing device, or in any other suitable manner. The occupancy estimate may also indicate that the two adults are expected to return to the house around 6:30 pm that evening.

The hub computing device may use the occupancy estimate to determine an appropriate mode for the security system of the smart home environment, and whether an automatic change to that mode is permitted or whether authorization from a user of the security system is needed. For example, the hub computing device may match the occupancy estimate with a set of mode rules. The mode rules may be, for example, parameter-based or conditional-clause based rules that may specify which mode a security system should be in based on the contents of the occupancy estimate. For example, a mode rule may specify that if the occupancy estimate indicates that a home has no human occupants then the security system should be set to an away mode. The mode rules may specify that if the occupancy estimate indicates that all occupants are in bedrooms in the home, and it is after 10 pm, then the security system should be set to a night mode. The mode rules may specify that if the occupancy estimate indicates that all occupants and pets are absent from the home, The mode rules may also specify whether the hub computing device is permitted to automatically change the security system to the mode indicated by the mode rules. For example, the mode rules may specify that if the last occupant in the home has just exited the home, and no occupants are expected to enter the home in the near future, that the security system can be automatically switched from a home mode to an away mode. This switch may occur without input from any of the users of the security system, who may be, for example, residents of the home. A notification may be sent to the user of the security system, for example, on a personal computing device such as a smartphone, indicating that automatic mode switch. This may automatically arm the security system of the home right after it becomes empty, so that the last person to leave does not have to manually change the mode of the security system to arm it.

The mode rules may specify that if the occupancy estimate indicates that there are no occupants currently in the home, but one resident is expected to return to the home within 2 minutes, the security system can be changed from the away mode to the home mode, but not automatically. The hub computing device may send a mode change request to a user of the security system, such as a resident of a home, whom the occupancy estimate indicates is returning, requesting authorization to switch from the away mode to the home mode. The mode change request may be sent to a personal computing device associated with the user, such as a smartphone. This may allow the resident to change the mode of the security system to a less secure mode just before their arrival so they don't have to manually disarm the security system to enter the home. Similarly, the resident may indicate that the security system should not change to the less secure mode because they will not be arriving when expected.

The mode rules may be pre-set and pre-installed on the hub computing device. The mode rules may be customizable by a user of the security system. The user may determine which modes should be selected based on the properties of occupancy estimates, and whether the mode changes for different mode selections and occupancy estimates should be automatic or require authorization from the user. For example, a user may customize mode rules to account for the addition of pets, babysitters, and additional family members or other long-term guests.

When the security system, with the hub computing device, is first installed in a home, the occupancy model used by the security system may be pre-trained on a generic freestanding home. For example, the occupancy model, which may be a set of weights for a machine learning system, may encode an estimation that if all of the occupants of a home are absent from the home on a weekday at 5:58 pm, the first occupant may be expected to arrive back at the home at 6:00 pm. The mode rules installed on the hub computing device may indicate that when the occupancy estimate indicates that the home is empty but an occupant is expected to return within the next two minutes, then a mode change request should be sent to a user requesting authorization to change the security system to a stay mode, which may, for example, disarm sensors monitoring the front door.

The first occupant of the home may not actually return home until 7:00 pm on weekdays. The occupant may deny the mode change request whenever it is presented, and the hub computing device may have occupancy estimates the estimate the presence of a person between 6:00 pm and 7:00 pm corrected, for example, based on a rules based interpretation of the signals from the sensors throughout the home, which may all indicate that no occupants are present. This may result in the occupancy model being trained to generate occupancy estimates for the home that indicates that no occupants are present between 6:00 pm and 7:00 pm. The arrival of the occupant at 7:00 pm may also be incorporated into the training of the occupancy model, for example, through the sensor signals and rules based interpretation of the signals being used to correct the occupancy estimate. The occupancy model may then produce occupancy estimates at 6:58 pm that indicate the occupant is expected to return at 7:00 pm, and the hub computing device may send a mode change request to the occupant at 6:58 pm, instead of at 5:58 pm as it did when originally installed. In this way, the occupancy model may learn to better estimate the current and potential future occupancy of the home, so that the mode rules may be better applied.

The occupancy model and the mode rules may be stored in any storage accessible to the hub computing device. The occupancy model may be stored in any suitable format for use with any suitable machine learning system, including, for example, as weights for a neural network or support vector machine based machine learning system. The mode rules may be stored in any suitable format for use by the hub computing device, and may be, for example, parameter based, where each rule may include a number of parameters regarding occupancy in an occupancy estimate that may need to be matched for a particular rule to apply to the occupancy estimate. A mode rule may also include a mode of the security system that may be considered appropriate when the parameters of the occupancy estimate match the mode rule, and an indication as to whether the mode rule permits the mode of the security system to be changed automatically or if authorization from a user is required.

When the hub computing device has determined that the mode of the security system should be changed based on the occupancy estimate, when the determined appropriate mode is different from the current mode, the hub computing device may notify a user of the smart home environment if the mode change is automatic, or send a mode change request to a user if the mode change requires authorization. For example, the hub computing device may send a message or request, via email, SMS, MMS, or application notification, to a computing device associated with a user of the smart home environment, such as a smartphone, tablet, laptop, or wearable computing device. The hub computing device may display a message, for example, on a display of the hub computing device or other display that is part of the smart home environment, such as a television or display on a smart thermostat, or may use, for example, a speaker and microphone system to audibly communicate with the user.

Figure 8:
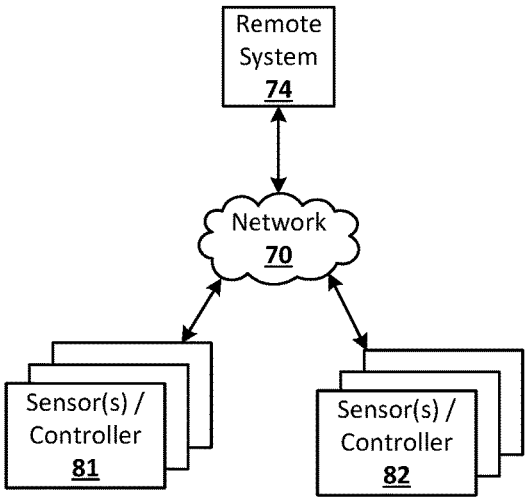
FIG. 8 shows a system according to an embodiment of the disclosed subject matter.

FIG. 1 shows an example system suitable for automatic security system mode selection according to an implementation of the disclosed subject matter. A hub computing device 100 may include a signal receiver 110, an occupancy estimator 120, a mode selector 130, and storage 140. The hub computing device 100 may be any suitable device, such as, for example, a computer 20 as described in FIG. 6, for implementing the signal receiver 110, the occupancy estimator 120, the mode selector 130, and storage 140. The hub computing device 100 may be, for example, a controller 73 as described in FIG. 8. The hub computing device 100 may be a single computing device, or may include multiple connected computing devices, and may be, for example, a smart thermostat, other smart sensor, smartphone, tablet, laptop, desktop, smart television, smart watch, or other computing device that may be able to act as a hub for a smart home environment, which may include a security system and automation functions. The smart home environment may be controlled from the hub computing device 100. The hub computing device 100 may also include a display. The signal receiver 110 may be any suitable combination of hardware or software for receiving signals generated by sensors that may be part of the smart home environment and may be connected to the hub computing device 100. The occupancy estimator 120 may be any suitable combination of hardware and software generating an occupancy estimate for the environment from the signals generated by the sensor an occupancy model 141 in the storage 140. The mode selector 130 may be any suitable hardware and software for selecting a mode for the security system of the smart home environment based on the occupancy estimate and mode rules 142 stored in the storage 140. The occupancy model 141 and mode rules 142 may be stored the storage 140 in any suitable manner.

The hub computing device 100 may be any suitable computing device for acting as the hub of a smart home environment. For example, the hub computing device 100 may be a smart thermostat, which may be connected to various sensors throughout an environment as well as to various systems within the environment, such as HVAC systems, or it may be another device within the smart home environment. The hub computing device 100 may include any suitable hardware and software interfaces through which a user may interact with the hub computing device 100. For example, the hub computing device 100 may include a touchscreen display, or may include web-based or app based interface that can be accessed using another computing device, such as a smartphone, tablet, or laptop. The hub computing device 100 may be located within the same environment as the smart home environment it controls, or may be located offsite. An onsite hub computing device 100 may use computation resources from other computing devices throughout the environment or connected remotely, such as, for example, as part of a cloud computing platform. The hub computing device 100 may be used to arm a security system of the smart home environment, using, for example, an interface on the hub computing device 100. The security system may be interacting with by a user in any suitable matter, including through a touch interface or voice interface, and through entry of a PIN, password, or pressing of an "arm" button on the hub computing device 100.

The hub computing device 100 may include a signal receiver 110. The signal receiver 110 may be any suitable combination of hardware and software for receiving signals from sensors connected to the hub computing device 100. For example, the signal receiver 110 may receive signals from any sensors distributed throughout a smart home environment, either individually or as part of sensor devices. The signal receiver 110 may receive any suitable signals from the sensors, including, for example, audio and video signals, signals indicating light levels, signals indicating detection or non-detection of motion, signals whether entryways are open, closed, opening, closing, or experiencing any other form of displacement, signals indicating the current climate conditions within and outside of the environment, smoke and carbon monoxide detection signals, and signals indicating the presence or absence of occupants in the environment based on Bluetooth or WiFi signals and connections from electronic devices associated with occupants or fobs carried by occupants. The signal receiver 110 may pass received signals to other components of the hub computing device 100 for further processing, such as, for example, detection of tripped motion and entryway sensors and use in automation and security determinations, and for storage. The signal receiver 110 may also be able to receive, or to associate with a received signal, an identification for the sensor from which the signal was received. This may allow the signal receiver 110 to distinguish which signals are being received from which sensors throughout the smart home environment. The signal receiver 110 may be able to filter signals based on type of sensor that generated the signal. For example, the signal receiver may be able to send only signals generated by sensors relating to the occupancy of the environment to the occupancy estimator 120.

The hub computing device 100 may include an occupancy estimator 120. The occupancy estimator 120 may be any suitable combination of hardware and software for generating an occupancy estimate for the environment based on the signals from the various sensors. The occupancy estimator 120 may use any suitable machine learning system to generate an occupancy estimate from the environment based on the signals from the various sensors and the occupancy model 141. The occupancy model 141 may be any suitable model of the occupancy of the environment in any suitable format for use with the occupancy estimator 120. For example, the occupancy model 141 may be a set of weights for use with a machine learning system of the occupancy estimator 120. The machine learning system of the occupancy estimator 120 may be trained in any suitable manner. For example, the occupancy model 141 may start as a set of random weights and be trained offline using training examples, or online using feedback from a user of the security system, or feedback from rules-based interpretation of signals from the various sensor. The occupancy model 141 may also be a pre-trained set of weights for the machine learning system of the occupancy estimator 120, which may then be further trained within the environment.

The hub computing device 100 may include a mode selector 130. The mode selector 130 may be any suitable combination of hardware and software for determining an appropriate mode for the security system of the smart home environment based on the occupancy estimate and the mode rules 142. The mode rules 142 may be parameter-based rules associating sets of parameters from the occupancy estimate with modes of the security system. For example, the mode rules 142 may specify a mode for the security system when the occupancy estimate indicates that there are no occupants in a home, when all of the residents are currently in the home, and when specific residents are in the home. The mode rules 142 may account for the time of day, day of week, day of month, day of year, recent or expected departure or arrival of occupants from an environment, distance from the environment as estimated by the occupancy estimator 120 based on, for example, remotely checking the location of a personal computing device of a resident of the environment if permitted by the resident, and any other suitable parameter that may be estimated by the occupancy estimator 120 or may otherwise affect the selection of an appropriate mode for the security system. The mode rules 142 may also specify when the mode selector 120 may automatically change the mode of security system, and when authorization from a user is needed to change the mode of the security system.

The mode selector 120 may compare the occupancy estimate to the mode rules 142, to determine which of the mode rules 142 may be matched by the occupancy estimate. The matching may be parameter based, for example, with one of the mode rules 142 matching an occupancy estimate when all of the parameters in the mode rule match all of the parameters from an occupancy estimate. The mode selector 120 may also use best-matching when none of the mode rules 142 is an exact match for the occupancy estimate. After determining a matching mode rule, the mode selector 120 may be able to automatically change the mode of the security system if the mode rule permits it. Otherwise, the mode selector 120 may send a mode change request to a user of the security system, and may only change the mode of the security system if the user authorizes it. If the mode for the security system specified by the matched mode rule is not different from the current mode of the security system, the mode selector 120 may do nothing.

The storage 140 may be any suitable storage hardware connected to the hub computing device 100, and may store the occupancy model 141 and the mode rules 142 in any suitable manner. For example, the storage 140 may be a component of the hub computing device, such as a flash memory module or solid state disk, or may be connected to the hub computing device 100 through any suitable wired or wireless connection. It may be a local storage, i.e., within the environment within which the hub computing device operates, or it may be partially or entirely operated by a remote service, such as a cloud-based monitoring service as described in further detail herein. The occupancy model 141, which may be, for example, a set of weights for a machine learning system, may be stored in any suitable manner and format for use by the machine learning system of the occupancy estimator 120. Any number of mode rules 142 may be stored in the storage 140, each of which may be a represent a particular set of parameters from an occupancy estimate and an associated mode for the security system. A mode rule may be stored in any suitable format, including, for example, as a set of parameters or conditional clauses. A mode rule may also specify whether a mode change may be made automatically or may require authorization from a user of the security system.

Figure 2:
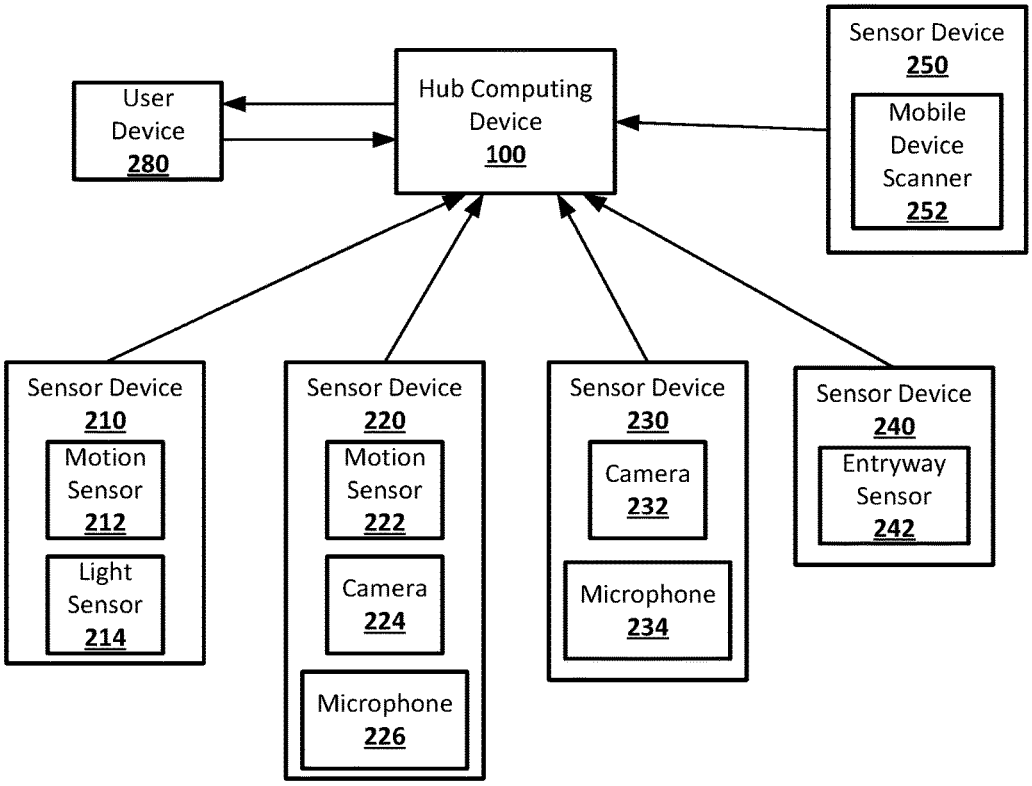
FIG. 2 shows an example arrangement suitable for automatic security system mode selection according to an implementation of the disclosed subject matter.

FIG. 2 shows an example arrangement suitable for automatic security system mode selection according to an implementation of the disclosed subject matter. The hub computing device 100 may be the hub, or controller, for a smart home environment. Various sensor devices throughout the environment may be connected to the hub computing device 100. Each sensor device may have any suitable assortment of sensors, For example, the sensor devices 210, 220, 230, 240 and 250 may be connected to the hub computing device 100. The sensor device 210 may include a motion sensor 212 and a light sensor 214. The sensor device 220 may include a motion sensor 222, a camera 224, and a microphone 226. The sensor device 230 may include a camera 232 and a microphone 234. The sensor device 240 may include an entry sensor 242. The sensor device 250 may include a mobile device scanner 252. The motions sensors 212 and 222 may be any suitable sensors for detecting motion in an environment, such as, for example, a low power motion sensor using a passive infrared sensor to detect the motion of heat. The light sensor 214 may be any suitable sensor for detecting light levels within an environment. The entryway sensor 242 may be any suitable type of sensor, such as contact sensors, including magnetic contact sensors, and tilt sensors, for detecting when an entryway is open. For example, the entryway sensor 242 may be a sensor attached to a bedroom window in a home, and may detect when the bedroom window has been moved in any way, for example moved towards an open or closed position, and may also measure vibrations or impacts experienced by the window. The mobile device scanner 252 may use WiFi, Bluetooth, RFID, or any other suitable wireless protocol to detect the presence of mobile personal computing devices or fobs associated with occupants of the environment, including, for example, smartphones known to belong to residents of the environment, smartphones that are not recognized as belonging to a resident of the environment, and fobs or RFID tags used on pets. The mobile device scanner 252 may be a separate physical sensor device, or may be any suitable combination of hardware and software on the hub computing device 100 or other component of the smart home environment.

The sensors of the sensors devices 210, 220, 230, 240, and 250 may generate signals that may be received by the signal receiver 110 of the hub computing device 100. The signals may be the product of active output the sensors, for example, a video or audio signal produced by the camera 224 or microphone 226, or may be the result of a sensor not generating any output, for example, a lack of output from the motion sensor 212 when no motion is detected.

The hub computing device 100 may also be connected, in any suitable manner, to a user computing device 280. The user computing device 280 may be any suitable computing device, such as, for example, a smartphone, tablet, laptop, or smartwatch or other wearable computing device, which a user may use to interface with the hub computing device 100 and control the security system. The hub computing device 100 may be able to send notifications, alerts or requests to the user computing device 280, either through a direct connection, such as LAN connection, or through a WAN connection such as the Internet. This may allow the user of the user computing device 280 to monitor and manage the smart home environment even when the user is not physically near the hub computing device 100. For example, when mode selector 120 determines that the mode of the security system should be changed to a different mode, the hub computing device 100 may send a notification or request for action, for example, a mode change request, to the user computing device 280, depending on whether or not an automatic mode change is permitted. The user computing device 280 may be used by the user to respond to the request for action, for example, by providing an indication to the hub computing device 100 of whether or not the mode selector 120 should change the mode of the security system. The notification of an automatic mode change may also allow the user to override the mode change.

Figure 3:
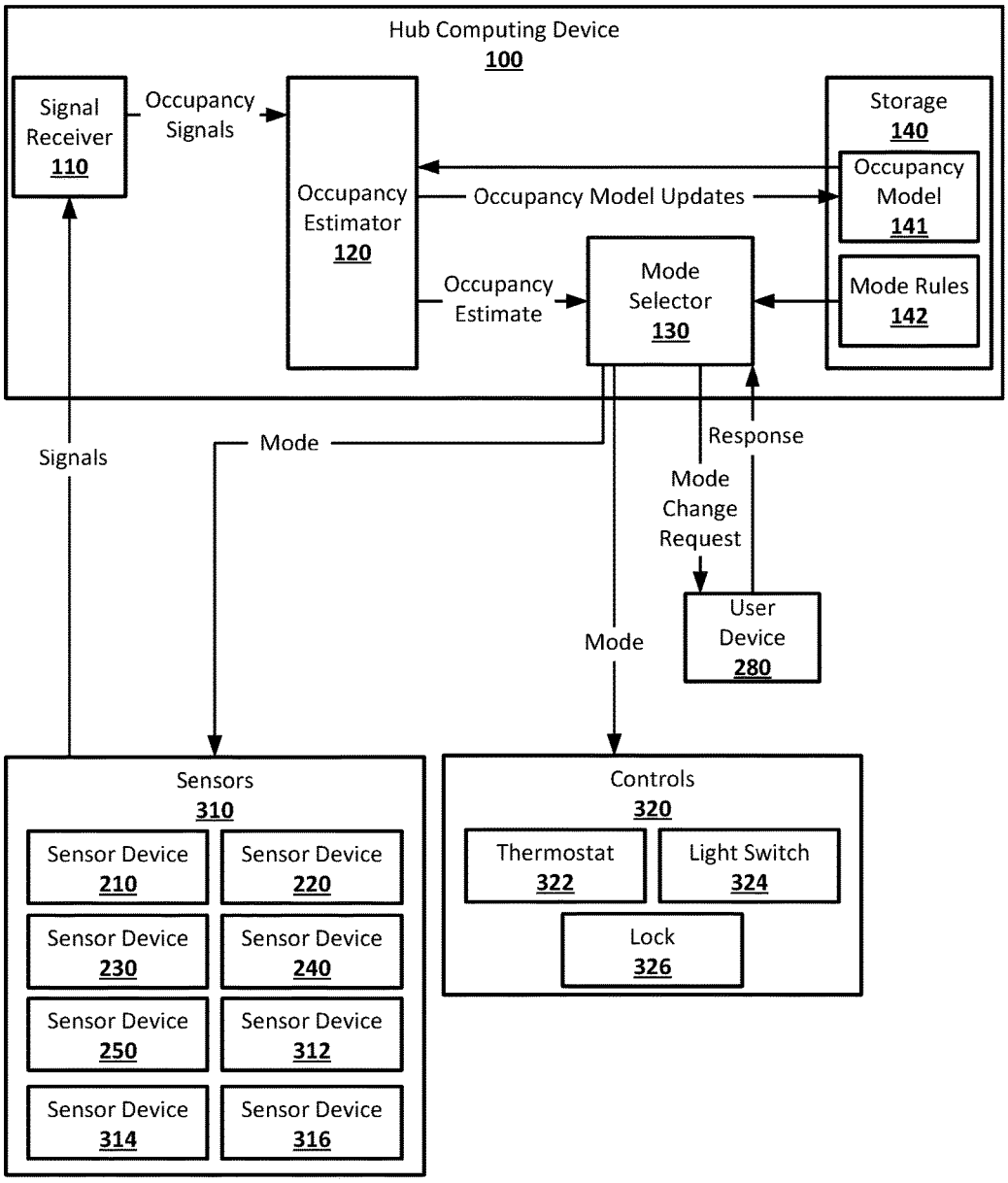
FIG. 3 shows an example arrangement suitable for automatic security system mode selection according to an implementation of the disclosed subject matter.

FIG. 3 shows an example arrangement suitable for automatic security system mode selection according to an implementation of the disclosed subject matter. The signal receiver 110 may receive signals from various sensors 310 distributed throughout the environment. The sensors 310 may include the sensors on the sensor devices 210, 220, 230, 240, 250, 312, 314, and 316, including, for example, motion sensors 212 and 222, cameras 224 and 232, microphones 226 and 234, entryway sensor 242, mobile device scanner 252, light sensor 214, smoke detectors, carbon monoxide detectors, and any other sensors in the environment, including other motion and entryway sensors, smart light switches, and the like. The signals received from the sensors 310 may indicate the current status of the aspect of the environment monitored by each of the sensors 310. For example, the signal from the microphone 226 may be an audio signal, the signal from a smart light switch may indicate whether the switch is on or off and may be used to infer if the switch has been flipped, the signal from the light sensor 214 may be a light level, the signal from the entryway sensor 242 may indicate whether the entryway is open, partially open, or closed, or is experiencing any other disturbance to its position, and the signal mobile device scanner 252 may indicate what personal computing devices, fobs, or RFID tags have been detected within the environment.

The occupancy estimator 120 may receive the signals from the signal receiver 110. The occupancy estimator 120 may receive all of the signals from the sensors 310 and may filter out any signals not related to occupancy of the environment, or may receive the occupancy signals after other signals have been filtered out by, for example, the signal receiver 110. The occupancy estimator 120 may also receive the occupancy model 141 from the storage 140. The occupancy signals and the occupancy model 141 may be used to generate an occupancy estimate for the environment. For example, the occupancy estimator 120 may be a machine learning system and the occupancy model 141 may be a set of weights for the machine learning system. The occupancy estimator 120 may also use time of day, day of week, day of month, and month of year when generating the occupancy estimate. The occupancy signals may be applied to the machine learning system as input, and the output of the machine learning system may be the occupancy estimate. The occupancy estimate may include an indication of the number and identity of occupants in the environment, whether the occupants are residents, known guests, or unknown, the number of pets in the environment, the location of occupants and pets within the environment, whether any occupants have recently entered or exited the environment, whether any occupants are expected to enter or exit the environment in the near future, the length of time an occupant who is a resident has been present in or absent from the environment, and any other suitable information regarding the occupancy of the environment.

For example, a home may have four residents, two adults and two children. The occupancy estimator 120 may receive signals including audio and video signals on which voice and face recognition has been performed, indications of motion from motion sensors such as the motion sensor 212, and other signals which may result in an occupancy estimate indicating that the two adults and the two children are in the home, and they are all located in the kitchen. The occupancy estimate may also indicate that all of the residents currently in the home are expected to exit the home within the next 2 minutes. For example, it may be 8:28 am on a weekday morning, and all of the residents of the home may leave for work or school around 8:30 am, which may have been learned by the machine learning system and encoded in the occupancy model 141.

The occupancy estimator 120 may also update the occupancy model 141. For example, if the hub computing device 100 receives feedback about the accuracy of the occupancy estimate from, for example, a user, or from cross-checking with a rules-based interpretation of the signals from the sensors 310 or other sources of data that may be relevant to location of occupants of the environment, then the occupancy model 141 may be further trained using any suitable machine learning techniques. The adjustments made to the occupancy model 141 as a result of the training may be stored in the storage 140, for example, as an updated version of the occupancy model 141.

The occupancy estimate generated by the occupancy estimator 120 may be received by the mode selector 130. The mode selector 130 may also receive the mode rules 142 from the storage 140. The mode selector 130 may attempt to match occupancy estimate with one of the mode rules 142, for example, using parameter-based or conditional clause based matching, to determine an appropriate mode for the security system. A matched mode rule may specify both the appropriate mode for the security system given that rule was matched by the occupancy estimate, and whether the mode selector 130 can change the mode of the security system or automatically or if authorization from a user is required. For example, one of the mode rules 142 may apply when the occupancy estimate indicates that all of the residents of a home have recently exited the home on a weekday morning. The mode rule may specify that the mode of the security system should be automatically changed to an away mode, arming the security system, and the sensors 310, as the home may be unoccupied and the residents may not be expected to return shortly.

After determining an appropriate mode for the security system, the mode selector 130 may automatically change the mode of the security system, request authorization to change the mode, or, if the appropriate mode is the same as the current mode, do nothing. For example, if the matched mode rule indicates that the appropriate mode for the security system is different from the current mode and that an automatic mode change is permitted, the mode selector 130 may affect the mode change automatically, without input from a user. The mode selector 130 may, for example, send any suitable signals to the sensors 310, and to the controls 320, placing the various sensors on the sensors devices, for sensors devices 210, 220, 230, 240, 250, 312, 314, and 316, and controls, such as thermostat 322, light switch 324, and lock 326 into an appropriate state based on the mode. For example, if the mode selector 130 is changing the security system from an unarmed mode, such as a stay mode, to an armed mode, such as an away mode, the mode selector 130 may arm the sensors 310, lower the thermostat 322, switch off the light switch 324 or place the light switch 324 on a timer, and cause the lock 326 to lock. The mode selector 130 may also send a notification of the mode change to a user of the security system, for example, a resident, on the user computing device 280. The notification may permit the user to override the mode change.

If the matched mode rule does not permit an automatic change of mode, the mode selector 130 may generate and transmit a mode change request to a user of the security system. For example, the mode change request may be sent to the user computing device 280, which may be a personal computing device such as smartphone, tablet, laptop, or wearable computing device associated with a user of the security system, who may be a resident of the environment. The user may respond to the mode change request by either authorizing the mode change, in which case the mode selector 130 may change the mode of the security system, or denying the mode change, in which case the mode selector 130 may not change the mode of the security system. There may be a waiting period of any suitable amount of time after a mode change request has been denied before the mode selector 130 sends another mode change request, in order to prevent a user from receiving multiple mode change requests in a short period of time after denying an initial mode change request. The user may also be able to respond to the mode change request with an authorization including a delay period, so that the mode selector 130 may wait for the length of the delay period before implementing a mode change. This may allow, for example, the user to delay the security system changing from an armed mode to unarmed mode in expectance of the user's arrival if the user is going to be late, preventing, for example, the lock 326 from being unlocked too far in advance of the user's arrival.

Figure 4:
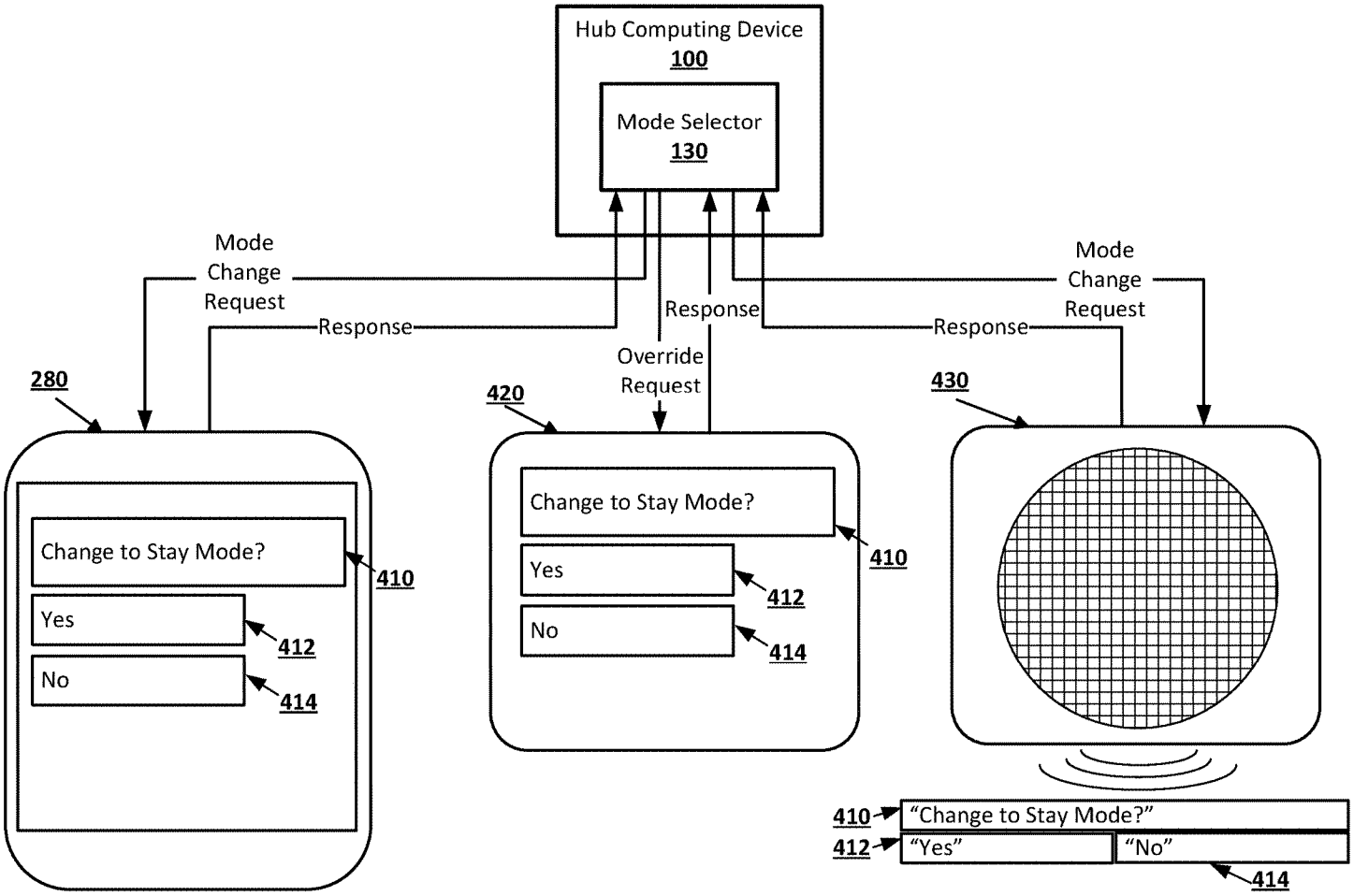
FIG. 4 shows an example arrangement suitable for automatic security system mode selection according to an implementation of the disclosed subject matter.

FIG. 4 shows an example arrangement suitable for automatic security system mode selection according to an implementation of the disclosed subject matter. The mode selector 130 may send notifications or mode change requests to a user of the security system in any suitable manner. For example, a mode change request may be sent to the display of the user computing device 280, a display 420 of the hub computing device 100 or other computing device within the smart home environment, or to a speaker 430 within the smart home environment. The mode change request may be sent any number of displays or speakers, which may be chosen, for example, based on their proximity to the user the mode change request is sent to. For example, if the user is currently an occupant of the environment and is near the speaker 430, the speaker 430 may be used to communicate the mode change request to the user. If the user is absent from the environment, the mode change request may be sent to the user computing device 280, which may be, for example, the user's smartphone. The mode change request may include, for example, a request 410, which may explain in written form or verbally that the mode selector 130 would like to change the mode of the security system, including what mode the security system is being changed to, along with response options, such as authorization option 412 and denial option 414. The user may review the request 410 and respond in an appropriate manner, for example, using a touchscreen user interface on smartphone or a verbal response to the speaker 430 to select the authorization option 412 or the denial option 414. The user's response may be sent back to the mode selector 130, which may then act in accordance with the response.

Figure 5:
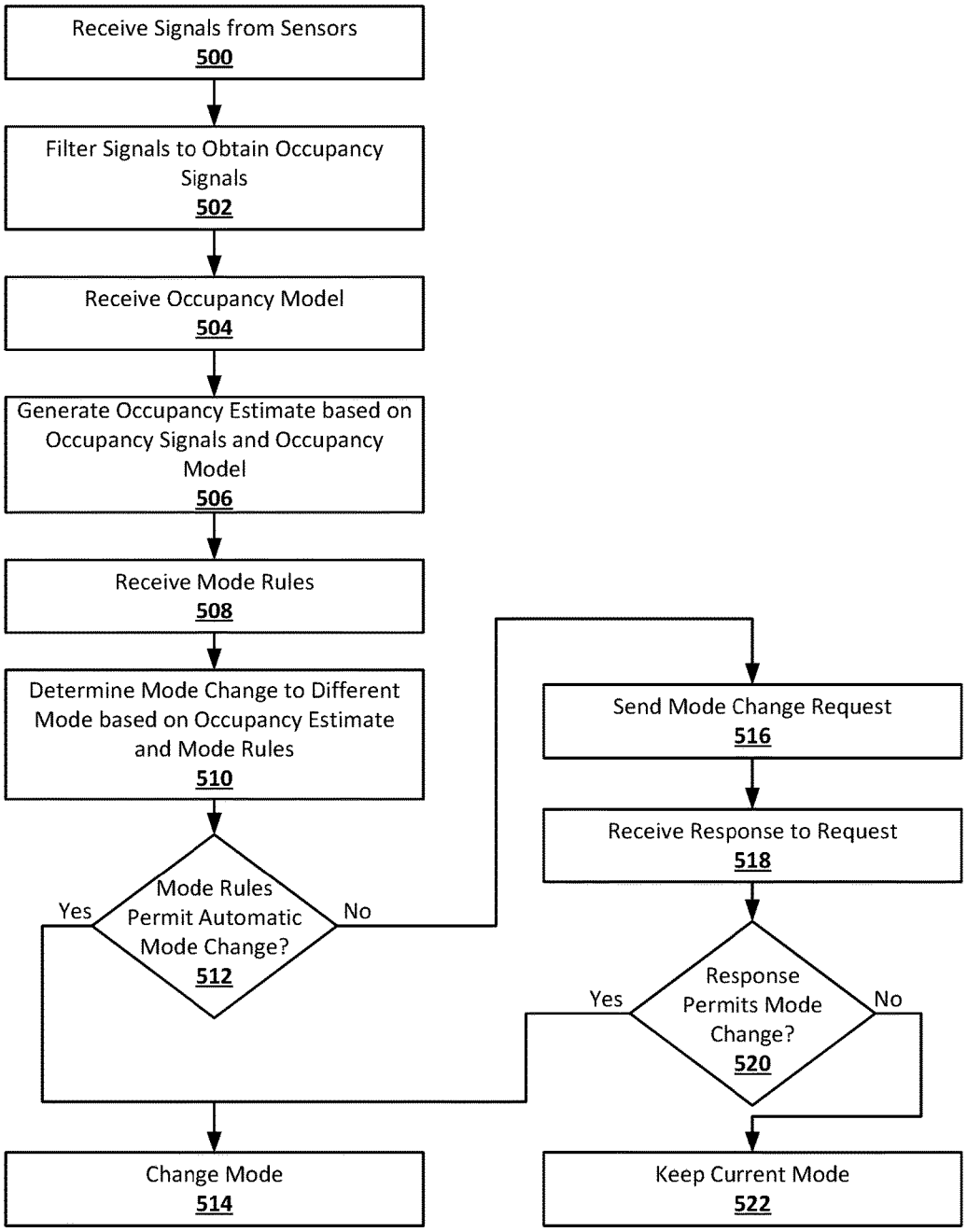
FIG. 5 shows an example of a process suitable for automatic security system mode selection according to an implementation of the disclosed subject matter.

FIG. 5 shows an example of a process suitable for automatic security system mode selection according to an implementation of the disclosed subject matter. At 500, signals may be received from sensors. For example, the signal receiver 110 of the hub computing device 100 may receive signals from the sensors 310, including sensors such as the motion sensors 212 and 222, the cameras 224 and 232, the microphones 226 and 234, the entryway sensor 242, the mobile device scanner 252, the light sensor 214, smoke detectors, carbon monoxide detectors, and any other sensors that are connected to the smart home environment.

At 502, the signals may be filtered to obtain the occupancy signals. For example, the signals may be filtered by the signal receiver 110, or the occupancy estimator 120, to obtain the signals which may be relevant to estimating the occupancy of the environment. For example, signals regarding smoke and carbon monoxide detection may be filtered out, as they may not be useful in determining if occupants are present or absent from the environment.

At 504, an occupancy model may be received. For example, the occupancy estimator 120 may receive the occupancy model 141 from the storage 140, which may be on or connected to the hub computing device 100. The occupancy estimator 120 may include a machine learning system, and the occupancy model 141 may be, for example, a set of weights for the machine learning system. The occupancy model 141 may have been generated through training of the machine learning system in any suitable manner, and may encode a model of the occupancy of the environment as related to signals from the sensors 310.

At 506, an occupancy estimate may be generated based on the occupancy signals and the occupancy model. For example, the occupancy signals may be applied as input to the machine learning system of the occupancy estimator 130. The machine learning system of the occupancy estimator 130 may use the occupancy model 141, which may be a set of weights for the machine learning system, to generate the occupancy estimate for the environment. The occupancy estimate may include indications of, for example, the number and identity of occupants in the environment, whether the occupants are residents, known guests, or unknown, the number of pets in the environment, the location of occupants and pets within the environment, whether any occupants have recently entered or exited the environment, whether any occupants are expected to enter or exit the environment in the near future, the length of time an occupant who is a resident has been present in or absent from the environment, and any other suitable information regarding the occupancy of the environment.

At 508, mode rules may be received. For example, the mode selector 130 may receive the mode rules 142 from the storage 140. The mode rules 142 may be, for example, parameter-based or conditional-clause based rules that may specify which mode a security system should be in based on the contents of the occupancy estimate, and whether a mode can be changed to automatically or if authorization from a user of the security system is required. For example, the mode rules 142 may be a set of rules, with each mode rule specifying a set of parameters that need to be matched to the occupancy estimate for the mode rule to apply.

At 510, a mode change to a different mode may be determined based on the occupancy estimate and the mode rules. For example, the mode selector 130 may determine which of the mode rules 142 matches, or is the best match for, the occupancy estimate. The mode associated with the matching mode rule may be different than the current mode of the security system. The matching may be performed in any suitable manner. For example, if the mode rules 142 are conditional-clause based, the mode selector 130 may apply the occupancy estimate to the conditional-clauses until an end point specifying an appropriate mode is reached. If the mode rules 142 are parameter-based, the mode selector 130 may determine which of the mode rules 142 exactly matches or best matches the parameters of the occupancy estimate, for example, specifying a matching number of occupants, matching occupant identities, matching occupant locations, and the like. The mode from the exact or best match mode rule may be the appropriate mode for the security system based on the occupancy estimate. If the mode associated with the mode rule is the same as the current mode of the security system, the mode selector 130 may do nothing, as the mode of the security system may not need to be changed.

At 512, whether the mode rules permit an automatic mode change may be determined. For example, the mode selector 130 may check the mode rule form the mode rules 142 that specifies the appropriate mode for the security system based on the occupancy estimate to determine if that mode rule specifies that the mode of the security system can be changed automatically. If the mode rule permits an automatic mode change, flow proceeds to 514. Otherwise, if the mode rule does not permit an automatic mode change, and instead requires authorization from a user of the security system, flow proceeds to 516.

At 514, the mode made be changed. For example, the mode selector 130 may change the mode of the security system of the smart home environment. Changing the mode may include, for example, sending signals to the sensors 310 and controls 320 to set them to appropriate states for the mode the security system is being changed to. For example, the sensors 310 may be armed when the security system is changed from an unarmed mode, for example, a stay mode, to an armed mode, for example, an away or vacation mode. Arming the sensors 310 may include any combination of changing the state of the sensors 310 and changing the way in which the hub computing device 100 interprets signals from the sensors 310. The controls 320 may also have their states changed, for example with the lock 326 changing from unlocked to locked when the security system is changed from an unarmed mode to an armed mode. If the security system is changed to a combination mode, for example, where some aspects of the security system are armed and other are unarmed, the mode selector 130 may arm the appropriate sensors while leaving other sensors unarmed.

At 516, a mode change request may be sent. For example, if the mode rule specifying the appropriate mode based on the occupancy estimate does not permit the mode of the security system to be changed automatically, a mode change request may be sent to a user of the security system. The mode change request may be sent in any suitable manner, to any suitable device accessible to the user, such as, for example, the user computing device 280, the display 210 of the hub computing device 100, or the speaker 430. The mode change request may be sent to the device most accessible to the user, who may be, for example, a resident of the environment who has either recently left or is expected to arrive shortly, or is an otherwise authorized user of the security system. The mode change request may include, for example, the request 410, the authorization option 412, and the denial option 414, presented to the user in any suitable manner.

At 518, a response to the mode change request may be received. The response, which may be sent by the user using, for example, the user computing device 280, the display 210 of the hub computing device 100, or the speaker 430, may indicate whether the user has selected the authorization option 412 or the denial option 414. The response may be received by, for example, the mode selector 130.

At 520, whether the response permits a mode change may be determined. For example, the mode selector 130 may determine if the user has selected the authorization option 412, permitting the mode selector 130 to change the mode the security system, or the denial option 414, preventing the mode selector 130 from changing the mode of the security system. If the mode change has been permitted by the user, flow proceeds to 514, where the mode may be changed by, for example, the mode selector 130. Otherwise, flow proceeds to 522.

At 522, the current mode may be kept. For example, the user may have chosen the denial option 414, preventing the mode selector 130 from changing the mode of the security system. The security system may be kept in whatever mode it was in when the mode change request was sent to the user.

Embodiments disclosed herein may use one or more sensors. In general, a "sensor" may refer to any device that can obtain information about its environment. Sensors may be described by the type of information they collect. For example, sensor types as disclosed herein may include motion, smoke, carbon monoxide, proximity, temperature, time, physical orientation, acceleration, location, and the like. A sensor also may be described in terms of the particular physical device that obtains the environmental information. For example, an accelerometer may obtain acceleration information, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combinations thereof. In some cases, a sensor may operate as multiple sensor types sequentially or concurrently, such as where a temperature sensor is used to detect a change in temperature, as well as the presence of a person or animal.

In general, a "sensor" as disclosed herein may include multiple sensors or sub-sensors, such as where a position sensor includes both a global positioning sensor (GPS) as well as a wireless network sensor, which provides data that can be correlated with known wireless networks to obtain location information. Multiple sensors may be arranged in a single physical housing, such as where a single device includes movement, temperature, magnetic, and/or other sensors. Such a housing also may be referred to as a sensor or a sensor device. For clarity, sensors are described with respect to the particular functions they perform and/or the particular physical hardware used, when such specification is necessary for understanding of the embodiments disclosed herein.

Figure 6:
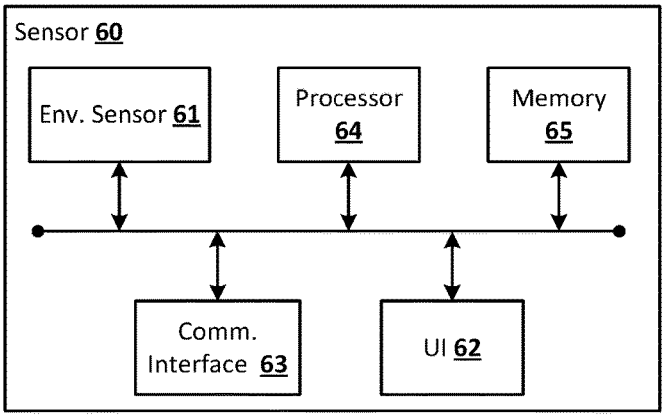
FIG. 6 shows a computing device according to an embodiment of the disclosed subject matter.

A sensor may include hardware in addition to the specific physical sensor that obtains information about the environment. FIG. 6 shows an example sensor as disclosed herein. The sensor 60 may include an environmental sensor 61, such as a temperature sensor, smoke sensor, carbon monoxide sensor, motion sensor, accelerometer, proximity sensor, passive infrared (PIR) sensor, magnetic field sensor, radio frequency (RF) sensor, light sensor, humidity sensor, or any other suitable environmental sensor, that obtains a corresponding type of information about the environment in which the sensor 60 is located. A processor 64 may receive and analyze data obtained by the sensor 61, control operation of other components of the sensor 60, and process communication between the sensor and other devices. The processor 64 may execute instructions stored on a computer-readable memory 65. The memory 65 or another memory in the sensor 60 may also store environmental data obtained by the sensor 61. A communication interface 63, such as a Wi-Fi or other wireless interface, Ethernet or other local network interface, or the like may allow for communication by the sensor 60 with other devices. A user interface (UI) 62 may provide information and/or receive input from a user of the sensor. The UI 62 may include, for example, a speaker to output an audible alarm when an event is detected by the sensor 60. Alternatively, or in addition, the UI 62 may include a light to be activated when an event is detected by the sensor 60. The user interface may be relatively minimal, such as a limited-output display, or it may be a full-featured interface such as a touchscreen. Components within the sensor 60 may transmit and receive information to and from one another via an internal bus or other mechanism as will be readily understood by one of skill in the art. One or more components may be implemented in a single physical arrangement, such as where multiple components are implemented on a single integrated circuit. Sensors as disclosed herein may include other components, and/or may not include all of the illustrative components shown.

Sensors as disclosed herein may operate within a communication network, such as a conventional wireless network, and/or a sensor-specific network through which sensors may communicate with one another and/or with dedicated other devices. In some configurations one or more sensors may provide information to one or more other sensors, to a central controller, or to any other device capable of communicating on a network with the one or more sensors. A central controller may be general- or special-purpose. For example, one type of central controller is a home automation network, that collects and analyzes data from one or more sensors within the home. Another example of a central controller is a special-purpose controller that is dedicated to a subset of functions, such as a security controller that collects and analyzes sensor data primarily or exclusively as it relates to various security considerations for a location. A central controller may be located locally with respect to the sensors with which it communicates and from which it obtains sensor data, such as in the case where it is positioned within a home that includes a home automation and/or sensor network. Alternatively or in addition, a central controller as disclosed herein may be remote from the sensors, such as where the central controller is implemented as a cloud-based system that communicates with multiple sensors, which may be located at multiple locations and may be local or remote with respect to one another.

Figure 7:
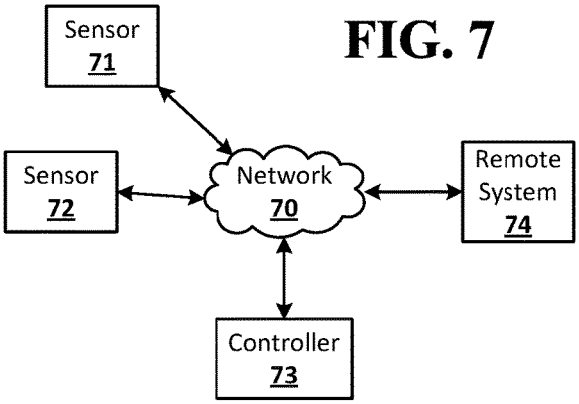
FIG. 7 shows a system according to an embodiment of the disclosed subject matter.

FIG. 7 shows an example of a sensor network as disclosed herein, which may be implemented over any suitable wired and/or wireless communication networks. One or more sensors 71, 72 may communicate via a local network 70, such as a Wi-Fi or other suitable network, with each other and/or with a controller 73. The controller may be a general- or special-purpose computer. The controller may, for example, receive, aggregate, and/or analyze environmental information received from the sensors 71, 72. The sensors 71, 72 and the controller 73 may be located locally to one another, such as within a single dwelling, office space, building, room, or the like, or they may be remote from each other, such as where the controller 73 is implemented in a remote system 74 such as a cloud-based reporting and/or analysis system. Alternatively or in addition, sensors may communicate directly with a remote system 74. The remote system 74 may, for example, aggregate data from multiple locations, provide instruction, software updates, and/or aggregated data to a controller 73 and/or sensors 71, 72.

For example, the hub computing device 100, the motion sensors 212 and 222, the camera 224, the microphone 226, and the entryway sensor 242, may be examples of a controller 73 and sensors 71 and 72, as shown and described in further detail with respect to FIGS. 1-5.

The devices of the security system and smart-home environment of the disclosed subject matter may be communicatively connected via the network 70, which may be a mesh-type network such as Thread, which provides network architecture and/or protocols for devices to communicate with one another. Typical home networks may have a single device point of communications. Such networks may be prone to failure, such that devices of the network cannot communicate with one another when the single device point does not operate normally. The mesh-type network of Thread, which may be used in the security system of the disclosed subject matter, may avoid communication using a single device. That is, in the mesh-type network, such as network 70, there is no single point of communication that may fail so as to prohibit devices coupled to the network from communicating with one another.

The communication and network protocols used by the devices communicatively coupled to the network 70 may provide secure communications, minimize the amount of power used (i.e., be power efficient), and support a wide variety of devices and/or products in a home, such as appliances, access control, climate control, energy management, lighting, safety, and security. For example, the protocols supported by the network and the devices connected thereto may have an open protocol which may carry IPv6 natively.

The Thread network, such as network 70, may be easy to set up and secure to use. The network 70 may use an authentication scheme, AES (Advanced Encryption Standard) encryption, or the like to reduce and/or minimize security holes that exist in other wireless protocols. The Thread network may be scalable to connect devices (e.g., 2, 5, 10, 20, 50, 100, 150, 200, or more devices) into a single network supporting multiple hops (e.g., so as to provide communications between devices when one or more nodes of the network is not operating normally). The network 70, which may be a Thread network, may provide security at the network and application layers. One or more devices communicatively coupled to the network 70 (e.g., controller 73, remote system 74, and the like) may store product install codes to ensure only authorized devices can join the network 70. One or more operations and communications of network 70 may use cryptography, such as public-key cryptography.

The devices communicatively coupled to the network 70 of the smart-home environment and/or security system disclosed herein may low power consumption and/or reduced power consumption. That is, devices efficiently communicate to with one another and operate to provide functionality to the user, where the devices may have reduced battery size and increased battery lifetimes over conventional devices. The devices may include sleep modes to increase battery life and reduce power requirements. For example, communications between devices coupled to the network 70 may use the power-efficient IEEE 802.15.4 MAC/PHY protocol. In embodiments of the disclosed subject matter, short messaging between devices on the network 70 may conserve bandwidth and power. The routing protocol of the network 70 may reduce network overhead and latency. The communication interfaces of the devices coupled to the smart-home environment may include wireless system-on-chips to support the low-power, secure, stable, and/or scalable communications network 70.

The sensor network shown in FIG. 7 may be an example of a smart-home environment. The depicted smart-home environment may include a structure, a house, office building, garage, mobile home, or the like. The devices of the smart home environment, such as the sensors 71, 72, the controller 73, and the network 70 may be integrated into a smart-home environment that does not include an entire structure, such as an apartment, condominium, or office space.

The smart home environment can control and/or be coupled to devices outside of the structure. For example, one or more of the sensors 71, 72 may be located outside the structure, for example, at one or more distances from the structure (e.g., sensors 71, 72 may be disposed outside the structure, at points along a land perimeter on which the structure is located, and the like. One or more of the devices in the smart home environment need not physically be within the structure. For example, the controller 73 which may receive input from the sensors 71, 72 may be located outside of the structure.

The structure of the smart-home environment may include a plurality of rooms, separated at least partly from each other via walls. The walls can include interior walls or exterior walls. Each room can further include a floor and a ceiling. Devices of the smart-home environment, such as the sensors 71, 72, may be mounted on, integrated with and/or supported by a wall, floor, or ceiling of the structure.

The smart-home environment including the sensor network shown in FIG. 7 may include a plurality of devices, including intelligent, multi-sensing, network-connected devices that can integrate seamlessly with each other and/or with a central server or a cloud-computing system (e.g., controller 73 and/or remote system 74) to provide home-security and smart-home features. The smart-home environment may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entryway interface devices (e.g., "smart doorbells"). The smart hazard detectors, smart thermostats, and smart doorbells may be the sensors 71, 72 shown in FIG. 7.

According to embodiments of the disclosed subject matter, the smart thermostat may detect ambient climate characteristics (e.g., temperature and/or humidity) and may control an HVAC (heating, ventilating, and air conditioning) system accordingly of the structure. For example, the ambient client characteristics may be detected by sensors 71, 72 shown in FIG. 7, and the controller 73 may control the HVAC system (not shown) of the structure.

A smart hazard detector may detect the presence of a hazardous substance or a substance indicative of a hazardous substance (e.g., smoke, fire, or carbon monoxide). For example, smoke, fire, and/or carbon monoxide may be detected by sensors 71, 72 shown in FIG. 7, and the controller 73 may control an alarm system to provide a visual and/or audible alarm to the user of the smart-home environment.

A smart doorbell may control doorbell functionality, detect a person's approach to or departure from a location (e.g., an outer door to the structure), and announce a person's approach or departure from the structure via audible and/or visual message that is output by a speaker and/or a display coupled to, for example, the controller 73.

In some embodiments, the smart-home environment of the sensor network shown in FIG. 7 may include one or more intelligent, multi-sensing, network-connected wall switches (e.g., "smart wall switches"), one or more intelligent, multi-sensing, network-connected wall plug interfaces (e.g., "smart wall plugs"). The smart wall switches and/or smart wall plugs may be the sensors 71, 72 shown in FIG. 7. The smart wall switches may detect ambient lighting conditions, and control a power and/or dim state of one or more lights. For example, the sensors 71, 72, may detect the ambient lighting conditions, and the controller 73 may control the power to one or more lights (not shown) in the smart-home environment. The smart wall switches may also control a power state or speed of a fan, such as a ceiling fan. For example, sensors 72, 72 may detect the power and/or speed of a fan, and the controller 73 may adjusting the power and/or speed of the fan, accordingly. The smart wall plugs may control supply of power to one or more wall plugs (e.g., such that power is not supplied to the plug if nobody is detected to be within the smart-home environment). For example, one of the smart wall plugs may controls supply of power to a lamp (not shown).

In embodiments of the disclosed subject matter, the smart-home environment may include one or more intelligent, multi-sensing, network-connected entry detectors (e.g., "smart entry detectors"). The sensors 71, 72 shown in FIG. 7 may be the smart entry detectors. The illustrated smart entry detectors (e.g., sensors 71, 72) may be disposed at one or more windows, doors, and other entry points of the smart-home environment for detecting when a window, door, or other entry point is opened, broken, breached, and/or compromised. The smart entry detectors may generate a corresponding signal to be provided to the controller 73 and/or the remote system 74 when a window or door is opened, closed, breached, and/or compromised. In some embodiments of the disclosed subject matter, the alarm system, which may be included with controller 73 and/or coupled to the network 70 may not arm unless all smart entry detectors (e.g., sensors 71, 72) indicate that all doors, windows, entryways, and the like are closed and/or that all smart entry detectors are armed.

The smart-home environment of the sensor network shown in FIG. 7 can include one or more intelligent, multi-sensing, network-connected doorknobs (e.g., "smart doorknob"). For example, the sensors 71, 72 may be coupled to a doorknob of a door (e.g., doorknobs 122 located on external doors of the structure of the smart-home environment). However, it should be appreciated that smart doorknobs can be provided on external and/or internal doors of the smart-home environment.

The smart thermostats, the smart hazard detectors, the smart doorbells, the smart wall switches, the smart wall plugs, the smart entry detectors, the smart doorknobs, the keypads, and other devices of the smart-home environment (e.g., as illustrated as sensors 71, 72 of FIG. 7 can be communicatively coupled to each other via the network 70, and to the controller 73 and/or remote system 74 to provide security, safety, and/or comfort for the smart home environment).

A user can interact with one or more of the network-connected smart devices (e.g., via the network 70). For example, a user can communicate with one or more of the network-connected smart devices using a computer (e.g., a desktop computer, laptop computer, tablet, or the like) or other portable electronic device (e.g., a smartphone, a tablet, a key FOB, and the like). A webpage or application can be configured to receive communications from the user and control the one or more of the network-connected smart devices based on the communications and/or to present information about the device's operation to the user. For example, the user can view can arm or disarm the security system of the home.

One or more users can control one or more of the network-connected smart devices in the smart-home environment using a network-connected computer or portable electronic device. In some examples, some or all of the users (e.g., individuals who live in the home) can register their mobile device and/or key FOBs with the smart-home environment (e.g., with the controller 73). Such registration can be made at a central server (e.g., the controller 73 and/or the remote system 74) to authenticate the user and/or the electronic device as being associated with the smart-home environment, and to provide permission to the user to use the electronic device to control the network-connected smart devices and the security system of the smart-home environment. A user can use their registered electronic device to remotely control the network-connected smart devices and security system of the smart-home environment, such as when the occupant is at work or on vacation. The user may also use their registered electronic device to control the network-connected smart devices when the user is located inside the smart-home environment.

Alternatively, or in addition to registering electronic devices, the smart-home environment may make inferences about which individuals live in the home and are therefore users and which electronic devices are associated with those individuals. As such, the smart-home environment "learns" who is a user (e.g., an authorized user) and permits the electronic devices associated with those individuals to control the network-connected smart devices of the smart-home environment (e.g., devices communicatively coupled to the network 70). Various types of notices and other information may be provided to users via messages sent to one or more user electronic devices. For example, the messages can be sent via email, short message service (SMS), multimedia messaging service (MMS), unstructured supplementary service data (USSD), as well as any other type of messaging services and/or communication protocols.

The smart-home environment may include communication with devices outside of the smart-home environment but within a proximate geographical range of the home. For example, the smart-home environment may include an outdoor lighting system (not shown) that communicates information through the communication network 70 or directly to a central server or cloud-computing system (e.g., controller 73 and/or remote system 74) regarding detected movement and/or presence of people, animals, and any other objects and receives back commands for controlling the lighting accordingly.

The controller 73 and/or remote system 74 can control the outdoor lighting system based on information received from the other network-connected smart devices in the smart-home environment. For example, in the event, any of the network-connected smart devices, such as smart wall plugs located outdoors, detect movement at night time, the controller 73 and/or remote system 74 can activate the outdoor lighting system and/or other lights in the smart-home environment.

In some configurations, a remote system 74 may aggregate data from multiple locations, such as multiple buildings, multi-resident buildings, individual residences within a neighborhood, multiple neighborhoods, and the like. In general, multiple sensor/controller systems 81, 82 as previously described with respect to FIG. 8 may provide information to the remote system 74. The systems 81, 82 may provide data directly from one or more sensors as previously described, or the data may be aggregated and/or analyzed by local controllers such as the controller 73, which then communicates with the remote system 74. The remote system may aggregate and analyze the data from multiple locations, and may provide aggregate results to each location. For example, the remote system 74 may examine larger regions for common sensor data or trends in sensor data, and provide information on the identified commonality or environmental data trends to each local system 81, 82.

In situations in which the systems discussed here collect personal information about users, or may make use of personal information, the users may be provided with an opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. Thus, the user may have control over how information is collected about the user and used by a system as disclosed herein.

Figure 9:
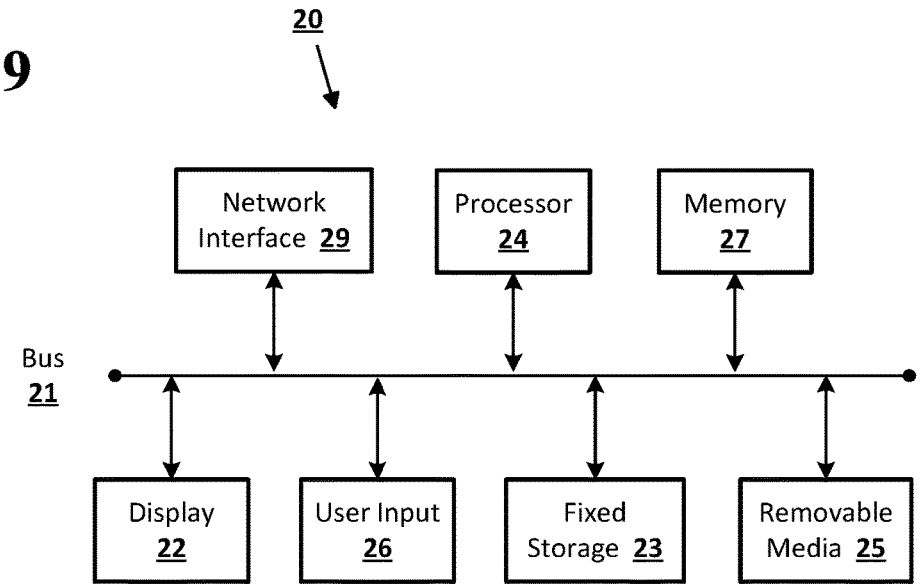
FIG. 9 shows a computer according to an embodiment of the disclosed subject matter.

Embodiments of the presently disclosed subject matter may be implemented in and used with a variety of computing devices. FIG. 9 is an example computing device 20 suitable for implementing embodiments of the presently disclosed subject matter. For example, the device 20 may be used to implement a controller, a device including sensors as disclosed herein, or the like. Alternatively or in addition, the device 20 may be, for example, a desktop or laptop computer, or a mobile computing device such as a smart phone, tablet, or the like. The device 20 may include a bus 21 which interconnects major components of the computer 20, such as a central processor 24, a memory 27 such as Random Access Memory (RAM), Read Only Memory (ROM), flash RAM, or the like, a user display 22 such as a display screen, a user input interface 26, which may include one or more controllers and associated user input devices such as a keyboard, mouse, touch screen, and the like, a fixed storage 23 such as a hard drive, flash storage, and the like, a removable media component 25 operative to control and receive an optical disk, flash drive, and the like, and a network interface 29 operable to communicate with one or more remote devices via a suitable network connection.

The bus 21 allows data communication between the central processor 24 and one or more memory components 25, 27, which may include RAM, ROM, and other memory, as previously noted. Applications resident with the computer 20 are generally stored on and accessed via a computer readable storage medium.

The fixed storage 23 may be integral with the computer 20 or may be separate and accessed through other interfaces. The network interface 29 may provide a direct connection to a remote server via a wired or wireless connection. The network interface 29 may provide such connection using any suitable technique and protocol as will be readily understood by one of skill in the art, including digital cellular telephone, WiFi, Bluetooth®, near-field, and the like. For example, the network interface 29 may allow the device to communicate with other computers via one or more local, wide-area, or other communication networks, as described in further detail herein.

Figure 10:
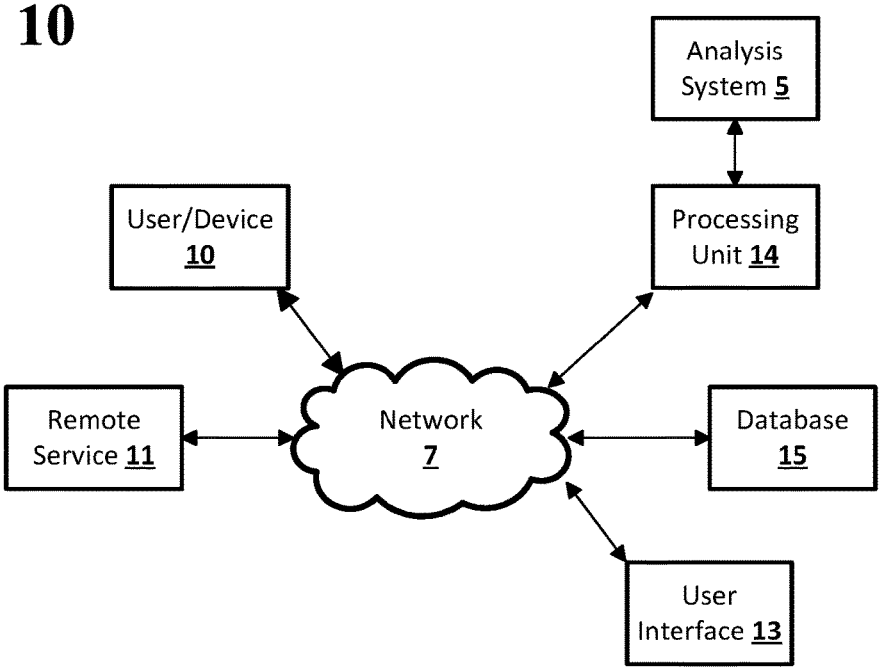
FIG. 10 shows a network configuration according to an embodiment of the disclosed subject matter.

FIG. 10 shows an example network arrangement according to an embodiment of the disclosed subject matter. One or more devices 10, 11, such as local computers, smart phones, tablet computing devices, and the like may connect to other devices via one or more networks 7. Each device may be a computing device as previously described. The network may be a local network, wide-area network, the Internet, or any other suitable communication network or networks, and may be implemented on any suitable platform including wired and/or wireless networks. The devices may communicate with one or more remote devices, such as servers 13 and/or databases 15. The remote devices may be directly accessible by the devices 10, 11, or one or more other devices may provide intermediary access such as where a server 13 provides access to resources stored in a database 15. The devices 10, 11 also may access remote platforms 17 or services provided by remote platforms 17 such as cloud computing arrangements and services. The remote platform 17 may include one or more servers 13 and/or databases 15.

Various embodiments of the presently disclosed subject matter may include or be embodied in the form of computer-implemented processes and apparatuses for practicing those processes. Embodiments also may be embodied in the form of a computer program product having computer program code containing instructions embodied in non-transitory and/or tangible media, such as hard drives, USB (universal serial bus) drives, or any other machine readable storage medium, such that when the computer program code is loaded into and executed by a computer, the computer becomes an apparatus for practicing embodiments of the disclosed subject matter. When implemented on a general-purpose microprocessor, the computer program code may configure the microprocessor to become a special-purpose device, such as by creation of specific logic circuits as specified by the instructions.

Embodiments may be implemented using hardware that may include a processor, such as a general purpose microprocessor and/or an Application Specific Integrated Circuit (ASIC) that embodies all or part of the techniques according to embodiments of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to embodiments of the disclosed subject matter.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A system for operating a security system, the system comprising:

a processor configured to:

generate, based on a first signal received from a first sensor, an occupancy estimate for an environment monitored by the security system, compare the occupancy estimate to a mode rule, change, in response to a match between the occupancy estimate and the mode rule, the security system from a first mode to a second mode, and cause, in response to a lack of the match between the occupancy estimate and the mode rule, a second signal to be sent to a device; and a network interface configured to send the second signal to the device.

2. The system of claim 1, wherein the occupancy estimate includes an estimate of a number of animals within the environment monitored by the security system.

3. The system of claim 1, wherein the processor is configured to change the security system from the first mode to the second mode based upon an indication, included in the mode rule, that enables the processor to change the security system from the first mode to the second mode.

4. The system of claim 1, wherein the processor is configured to change the security system from the first mode to the second mode based upon an indication, included in the mode rule, that a third signal must be received by the processor to enable the processor to change the security system from the first mode to the second mode.

5. The system of claim 1, wherein the match between the occupancy estimate and the mode rule is a best match between the occupancy estimate and the mode rule.

6. The system of claim 1, wherein the processor is configured to compare the occupancy estimate to the mode rule by:

comparing the occupancy estimate to the mode rule for an exact match between the occupancy estimate and the mode rule; and comparing, in response to a lack of the exact match between the occupancy estimate and the mode rule, the occupancy estimate to the mode rule for a best match between the occupancy estimate and the mode rule.

7. The system of claim 1, wherein the processor is further configured to:

receive a third signal from the device; and change, in response to a receipt of the third signal, the security system from the first mode to a third mode.

8. The system of claim 7, wherein the third mode is the second mode.

9. The system of claim 7, wherein the third signal includes information about a delay period and the processor is configured to change the security system from the first mode to the third mode by changing, after the delay period, the security system from the first mode the third mode.

10. The system of claim 1, wherein the processor is further configured to:

receive the first signal from the first sensor;

receive a third signal from a second sensor; and determine that the third signal is irrelevant to a generation of the occupancy estimate.

11. The system of claim 1, wherein the processor is configured to generate the occupancy estimate further based on an occupancy model.

12. The system of claim 11, wherein the occupancy model comprise a set of at least a weight or a vector, the at least the weight or the vector configured to be used with a machine learning system, the machine learning system trained to estimate an occupancy for the environment monitored by the security system.

13. The system of claim 11, wherein the processor is further configured to update the occupancy model based on a third signal that indicates an accuracy of the occupancy estimate.

14. The system of claim 11, wherein the processor is further configured to receive the occupancy model.

15. The system of claim 11, further comprising a memory configured to store the occupancy model.

16. The system of claim 1, wherein the processor is further configured to receive the mode rule.

17. The system of claim 1, further comprising a memory configured to store the mode rule.

18. The system of claim 1, wherein the device comprises at least one of a personal computing device, a display associated with the security system, or a speaker associated with the security system.

19. A method for operating a security system, the method comprising:

generating, by a processor and based on a first signal received from a first sensor, an occupancy estimate for an environment monitored by the security system;

comparing, by the processor, the occupancy estimate to a mode rule;

changing, by the processor and in response to a match between the occupancy estimate and the mode rule, the security system from a first mode to a second mode; and sending, by the processor and in response to a lack of the match between the occupancy estimate and the mode rule, a second signal to a device.

20. A non-transitory computer-readable medium storing computer code for controlling a processor to cause the processor to operate a security system, the computer code including instructions to cause the processor to:

generate, based on a first signal received from a first sensor, an occupancy estimate for an environment monitored by the security system;

compare the occupancy estimate to a mode rule;

change, in response to a match between the occupancy estimate and the mode rule, the security system from a first mode to a second mode; and send, in response to a lack of the match between the occupancy estimate and the mode rule, a second signal to a device.

* * * * *